US005486803A

United States Patent [19]

Igarashi et al.

[11] Patent Number: 5,486,803

[45] Date of Patent: Jan. 23, 1996

[54] SIGNAL DISCRIMINATOR

[75] Inventors: Osamu Igarashi, Yokohama; Akira Naitou, Sagamihara; Hikohiro Tougane, Sagamihara; Hironobu Tsutsumi, Sagamihara; Tosihisa Kudou, Sagamihara, all of Japan

[73] Assignees: Mitsubishi Denki Kabushiki Kaisha; Nikko Kogyo Kabushiki Kaisha, both of Tokyo, Japan

[21] Appl. No.: 206,278

[22] Filed: Mar. 7, 1994

Related U.S. Application Data

[63] Continuation of Ser. No. 816,570, Jan. 3, 1992, abandoned.

[30] Foreign Application Priority Data

| | | | |
|---|---|---|---|
| Jan. 24, 1991 | [JP] | Japan | 3-006836 |
| Jan. 24, 1991 | [JP] | Japan | 3-006837 |
| Jul. 1, 1991 | [JP] | Japan | 3-160330 |

[51] Int. Cl.[6] ..... H01F 17/06; H01F 27/02; H01F 27/26

[52] U.S. Cl. ..... 336/92; 333/12; 336/176; 336/212

[58] Field of Search ..... 336/174, 175, 336/176, 92, 233, 229, 212, 210; 324/127; 174/92, 138 F; 333/81 R, 12, 182, 243, 183

[56] References Cited

U.S. PATENT DOCUMENTS

| | | | |
|---|---|---|---|
| 4,005,380 | 1/1977 | Heilmann et al. | 336/176 |
| 4,885,559 | 12/1989 | Nakano | 336/175 |

FOREIGN PATENT DOCUMENTS

| | | | |
|---|---|---|---|
| 0257179 | 3/1988 | European Pat. Off. . | |
| 8801421 | 5/1988 | Germany . | |
| 3941915 | 7/1990 | Germany . | |
| 4004211 | 8/1990 | Germany . | |
| 4016809 | 12/1990 | Germany . | |
| 61-129475 | 8/1986 | Japan | 336/176 |
| 62-14770 | 4/1987 | Japan . | |
| 2201554 | 9/1988 | United Kingdom . | |
| 2201840 | 9/1988 | United Kingdom . | |
| 2205199 | 11/1988 | United Kingdom . | |
| 2207007 | 1/1989 | United Kingdom . | |
| 2230148 | 10/1990 | United Kingdom . | |
| 2233159 | 1/1991 | United Kingdom . | |
| 2241834 | 9/1991 | United Kingdom . | |

*Primary Examiner*—Thomas J. Kozma
*Attorney, Agent, or Firm*—Oblon, Spivak, McClelland, Maier & Neustadt

[57] ABSTRACT

A signal discriminator which comprises a plurality of divided magnetic cores which surround a peripheral part of a cable when the plurality of divided magnetic cores are integrated. A resin case formed of a plurality of sections is capable of opening and closing and accommodates the plurality of divided magnetic cores. A press-contacting device press-contacts at least one of the plurality of divided magnetic cores and a corresponding one of the plurality of sections of the resin case. Engaging protrusions on the plurality of divided magnetic cores engage with corresponding recesses on the plurality of sections of the resin case.

3 Claims, 18 Drawing Sheets

SIGNAL DISCRIMINATOR

This application is a continuation of application Ser. No. 07/816,570, filed on 01/03/92, now abandoned.

BACKGROUND OF THE INVENTION

1. Field of the Invention

This invention relates to a signal discriminator, and particularly to a signal discriminator which is attached to a cable for connecting electronic devices.

2. Discussion of the Background

Conventionally, as a device for absorbing noise which flows in a cable connected to an electronic device, and for preventing the noise from flowing into the electronic device, a device has been known which absorbs the noise by attaching a ferrite core which is a magnetic body, or the like around the cable.

FIGS. 20 and 21 are disclosed in Japanese Unexamined Utility Model Publication No. 13013/1987 (hereinafter the first conventional example).

In the first conventional example shown in FIGS. 20 and 21, a through hole is formed at the central portions of the ferrite cores 114 and 116 in the axial direction, and the cables 113 and 115 penetrate the ferrite cores.

In FIG. 20, a round cable is shown, and in FIG. 21, a flat cable is shown.

Furthermore, FIGS. 22 and 23 are disclosed in Japanese Unexamined Utility Model Publication No. 14770/1987 (hereinafter the second conventional example). The ferrite cores 118 and 120 are respectively divided in two in the axial direction, and respectively accommodated in the cases 117 and 119. In FIG. 22, an example of a round cable is shown, and in FIG. 23, that of a flat cable is shown.

Next, explanation will be given to the operation of the conventional examples using FIGS. 20 through 23.

Normally, when electric current flows in a cable, a magnetic field is generated around the cable, which varies with the frequency of the electric current. In order to absorb and eliminate unnecessary electric current other than signal current, a ferrite core is provided surrounding the cable, which has an impedance characteristic that passes the necessary signal and absorbs the unnecessary signal, thereby performing a filter action to absorb the unnecessary signal.

However, in FIGS. 20 and 21, the cable simply penetrates the ferrite core, and the attaching operationality thereof is not considered. Furthermore, in FIGS. 22 and 23, the divided ferrite cores are respectively accommodated in the cases 117 and 119 which are connected by a hinge, and the cases are latched simply by the resilience of the cases.

As stated above, since the conventional signal discriminator is constructed as above, in the signal discriminator of the first conventional example, the positioning attachment of the cable to the ferrite core is performed by using adhesive or a thermally contractive tube. Therefore many steps are required for the operation.

Furthermore, in the second conventional example, the contacting of the ferrite cores which are divided in the axial direction, is performed by pressure only due to the resilience of the cases. Therefore, in order to minimize magnetic reluctance of the cores, and to obtain a good filter characteristic, it is necessary to select the material of the cases and to prepare ferrite cores having high dimensional accuracy. Therefore the operation is complicated and necessitates high cost for the operation.

FIG. 35 is a perspective view of a conventional signal discriminator, (third conventional example) disclosed for instance, in Japanese Unexamined Utility Model Publication No. 133610/1985. In FIG. 35, a reference numeral 1 designates a ring-like magnetic core having the through hole 1*a* which the cable 2 penetrates. A numeral 3 designates a thermally contractive tube which fixes the magnetic core 1 to the cable 2, as well as protects the magnetic core 1.

Next, explanation will be given to the operation. When the magnetic core 1 is attached to the cable 2, one end of the cable 2 is disconnected from an electronic device to which the cable is connected, or from a connector or the like. The cable 2 is inserted into the through hole 1*a* of the magnetic core 1. The thermally contractive tube 3 is covered up on the magnetic core 1, and is contracted to secure the cable 2. After that, the end of the cable which is disconnected from the electronic device or from a connector or the like, is connected again to the electronic device or the connector as before.

FIG. 36 is an exploded perspective view of a conventional signal discriminator (fourth conventional example) utilizing divided magnetic cores, which is disclosed in Japanese Unexamined Utility Model Publication No. 91315/1990. In FIG. 36, a reference numeral 4 designates a divided magnetic core into which the magnetic core 1 is divided in the axial direction on the divided surface 1*b*, 5, a circular case which is fixed surroundingly around the cable 2, and which has the divided cases 5*a* and 5*b*, the hinge 6, the latches 7*a* and 7*b*, and the through holes 8*a* and 8*b*.

In the signal discriminator using the divided magnetic cores 4, the divided magnetic cores 4 are accommodated in the divided cases 5*a* and 5*b* of the case 5. The divided case 5*a* and 5*b* are closed and the latches 7*a* and 7*b* are connected, by which the case 5 is fixed to the cable 2, so that two divided magnetic cores 4 form a closed magnetic path around the cable 2. When electric current flows in the cable 2, the noise element of the signal is eliminated corresponding with the impedance characteristic of the magnetic core, and a necessary signal is discriminated.

Since the conventional signal discriminator is constructed as above, in the third conventional example shown in FIG. 35, when the signal discriminator is to be attached or detached, it is necessary to disconnect the cable 2 from a device or a connector to which one end of the cable 2 is connected. Furthermore it is necessary to exchange the thermally contractive tube 3.

On the other hand, in the fourth conventional example shown in FIG. 36, when the divided magnetic cores 4 are to be fixed to the cable 2, or are to be disconnected from the cable 2 , the divided magnetic cores 4 are easy to drop off from the case 5. Furthermore since the divided magnetic cores 4 are pressed by spring-like protrusions integrally formed with the case 5, it is necessary to enhance the dimensional accuracy of the divided magnetic cores 4, and to select the material of the case 5, to minimize the magnetic reluctance, and to obtain a good filter characteristic, which increases the cost of the signal discriminator.

SUMMARY OF THE INVENTION

It is an object of the present invention to make the shape of the divided magnetic core (hereinafter core) attachable and detachable to an accommodation means, and to simplify the contact-pressing the cores, thereby obtaining a high signal discriminating effect.

It is an object of the present invention to provide a signal discriminator which can hold the divided cores and contact-press them by an independent contact-pressing means which corresponds with the electromagnetic characteristic of the core, and to provide a signal discriminator which is inexpensive in the cost of the device, and is convenient in handling.

It is an object of the present invention to provide a signal discriminator in which the cores are easily fixed around the cable and forms a closed magnetic path without disconnecting the cable from devices or connectors and without dropping off the cores, and in which the pressing force can be changed according to the electromagnetic characteristic of the cores.

According to an aspect of the present invention, there is provided a signal discriminator which comprises: a plurality of divided magnetic cores; and a plurality of accommodating means for accommodating the plurality of divided magnetic cores; wherein the plurality of divided magnetic cores have a first shape and the plurality of the accommodating means have a second shape; the first and the second shapes enabling attaching and detaching the plurality of divided magnetic-cores to and from the plurality of the accommodating means.

According another aspect of the present invention, there is provided a signal discriminator adapted to be attached to a cable connected to an electric device which comprises: a magnetic core formed in a shape surrounding the cable and divided in the axial direction of the cable; an accommodating means for accommodating the magnetic core; a press-contacting means for retaining the magnetic core for engaging the magnetic core with the accommodating means, and for press-contacting the magnetic core.

According to another aspect of the present invention, there is provided a signal discriminator which comprises: a plurality of divided magnetic cores which surround a peripheral part of a cable when the plurality of divided magnetic cores are integrated; a plurality of cases capable of opening and closing which accommodate the plurality of divided magnetic cores; a press-contacting means for press-contacting each other a plurality of divided surfaces of the plurality of divided magnetic cores, which is arranged between one of the plurality of divided magnetic cores and a corresponding one of the plurality of cases; and an engaging means for engaging the plurality of divided magnetic cores with the plurality of cases.

DESCRIPTION OF THE PREFERRED EMBODIMENTS

Explanation will be given to embodiments of the present invention based of the drawings.

First, explanation will be given to a first embodiment of the present invention referring to FIGS. 1 through 4.

Figure 1:
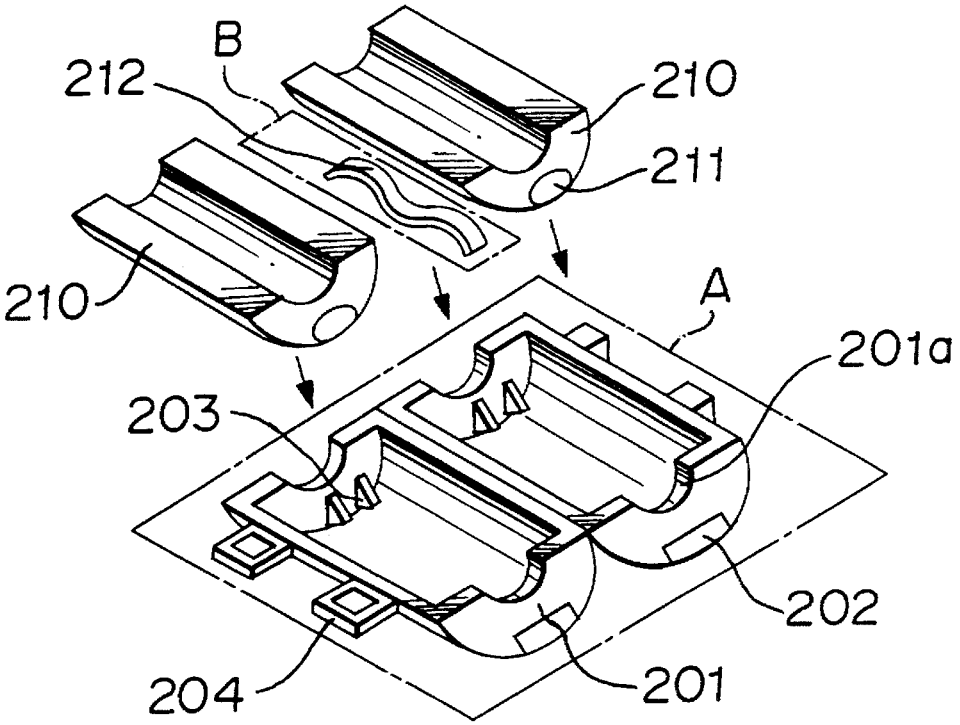
FIG. 1 is an exploded perspective view of a first embodiment of the signal discriminator according to the present invention.
Figure 2:
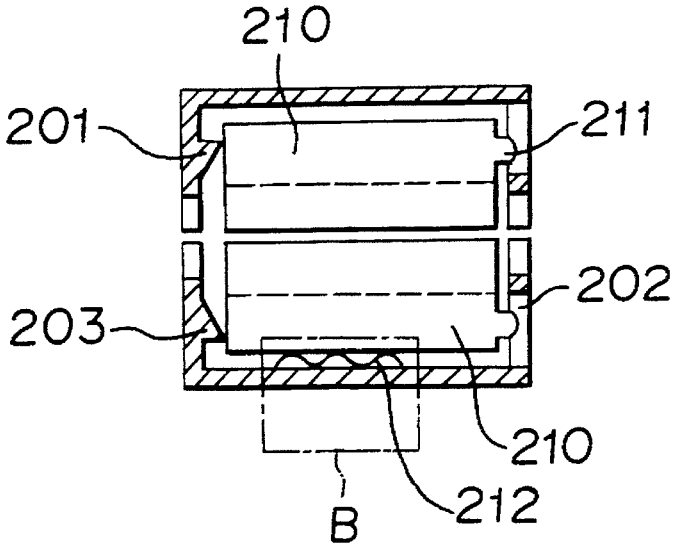
FIG. 2 is a partially broken sectional view showing the closed-state of the first embodiment of the signal discriminator.
Figure 3:
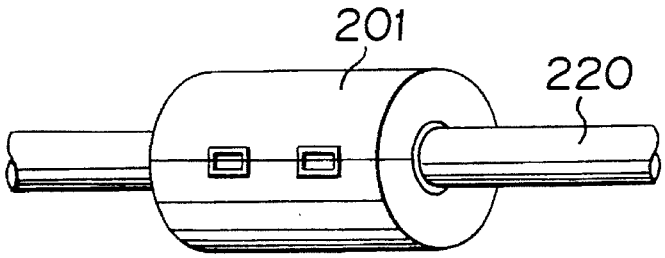
FIG. 3 is a perspective view that the first embodiment of the signal discriminator is attached to the cable.
Figure 4:
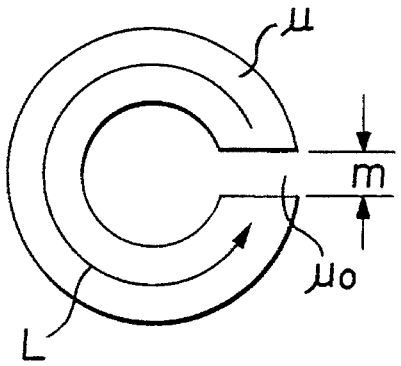
FIG. 4 is a diagram explaining the gap theory of a doughnut-like magnetic body.

FIG. 1 is an exploded perspective view of the first embodiment of the signal discriminator according to the present invention, FIG. 2, a partially broken sectional view showing the closed-state of the first embodiment of the signal discriminator, FIG. 3, a perspective view showing the attached state of the first embodiment to the cable, and FIG. 4, a diagram explaining the gap theory of a doughnut-like magnetic body.

In FIG. 1, a notation A designates an accommodation means, which is composed of the resin cases 201 and which accommodates the cores 210. A notation B designates a pressure applying means which is composed of the resilient press piece 212, and which presses the cores 210 to the resin cases 201. A notation 202 designates a window provided at the resin case 201 for retaining the detaching preventive protrusion 211 of the core 210 provided at an end of the core 210, 203, louvers for preventing positional deviation of the core 210, and 204, a latch for latching to close the resin cases 201.

Next, a simple explanation will be given to the gap theory of the doughnut-like magnetic body using FIG. 4, before explaining the operation of the first embodiment.

In FIG. 4, when the gap m is provided in the doughnut-like magnetic body, assuming the sectional area of core as S, the magnetic reluctance R is shown as below. (R is desirable to be as small as possible)

$$R=\frac{L}{\mu S}+\frac{m}{\mu_0 S}=\frac{\mu_0 L+\mu m}{\mu\mu_0 S}\approx\frac{L+\mu m}{\mu S}$$

where $\mu_0$ is the permeability of the air which is about 1.

The influence of the gap m becomes significant by the increase of $\mu$. It is necessary to minimize the gap m. Accordingly, it is necessary to set pressure for press-contacting the divided cores, corresponding with $\mu$.

Explanation will be given to the operation of the first embodiment referring to FIGS. 1 to 3.

FIG. 2 is a partially broken sectional diagram of the central part of the signal discriminator which is integrated by the parts in the exploded view of FIG. 1. When the core 210 is accommodated in the case 201, the detaching preventive protrusion 211 provided at an end of the core 210 is arranged in the window 202 of the case 201 for preventing the dropping off of the core 210. The louvers 203 of the case 201 prevent the positional deviation of the core 210 in the case 201 by pressing the core 210.

However, in the above arrangement, the core 210 has considerable freedom of motion in the case 201; although it does not drop off, it may move.

Accordingly, the press piece 212 is inserted between the side surface of the core 210 and the inner surface of the case 201, and pressure is applied on the core 210 by the press piece 202, and press-contacting is performed for the core 210 when the case 201 is closed and secured by the latch 204, around the cable 220 as shown in FIG. 3.

The resilience of the press piece 210 is selected corresponding with the magnetic property of the core 210.

In the first embodiment, a round type one is shown as the magnetic core, but it may be a flat type one.

Next, explanation will be given to a second embodiment of the present invention referring to FIG. 5.

Figure 5:
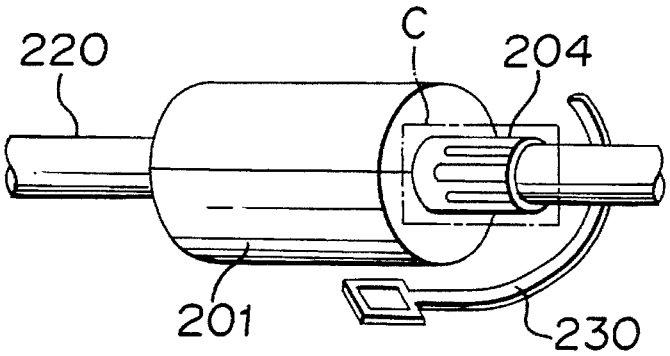
FIG. 5 is a perspective view of a second embodiment of the signal discriminator according to the present invention.

FIG. 5 is a perspective view of the second embodiment of the signal discriminator according to the present invention.

In FIG. 5, a reference numeral 204 designates a cable fixing nozzle provided at an end of the case 201, which constitutes the cable fixing means C. A numeral 230 designates a cable band which binds the nozle 204. The other construction is the same with that in the first embodiment.

By the above construction, the signal discriminator can be fixed to the cable by binding up the nozle 204 by the cable band 230. Therefore in this invention the same operation and the effect can be obtained as in the first embodiment.

As stated above, in this invention, the divided magnetic core of the signal discriminator has a shape which enables attaching and detaching of the core to the accommodation means. Therefore the press-contacting of the core for retaining the core is simplified, and a higher signal discriminating effect can be obtained.

Furthermore, a simplified accommodation means for accommodating the core, and a pressure applying means corresponding with the characteristic of the core, can be realized.

Next, explanation will be given to a third embodiment of the present invention referring to FIGS. 6 through 10.

Figure 6:
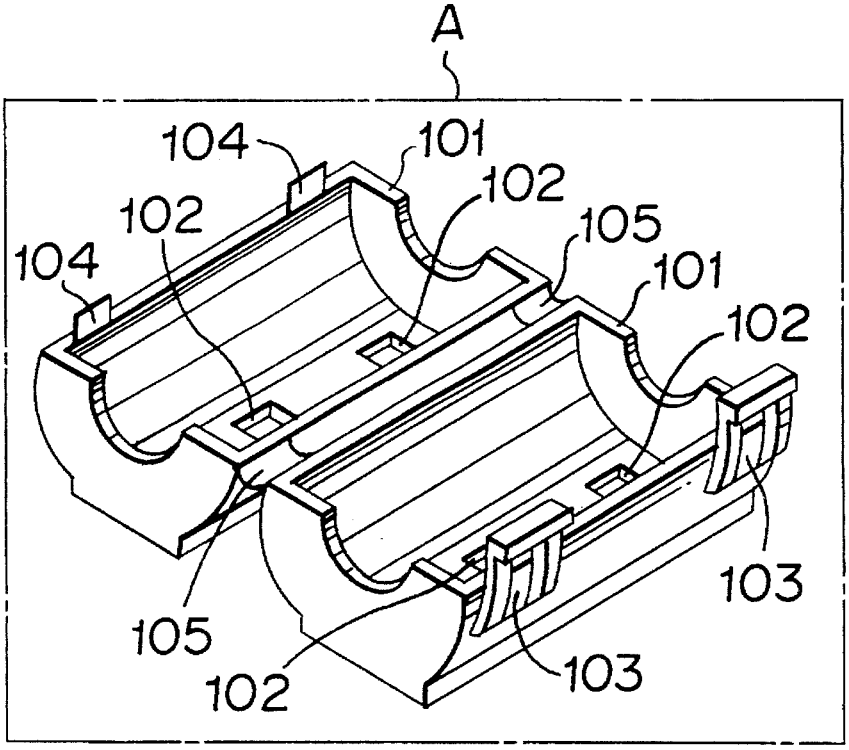
FIG. 6 is an exploded perspective view of accommodation cases in a third embodiment of the present invention.
Figure 7:
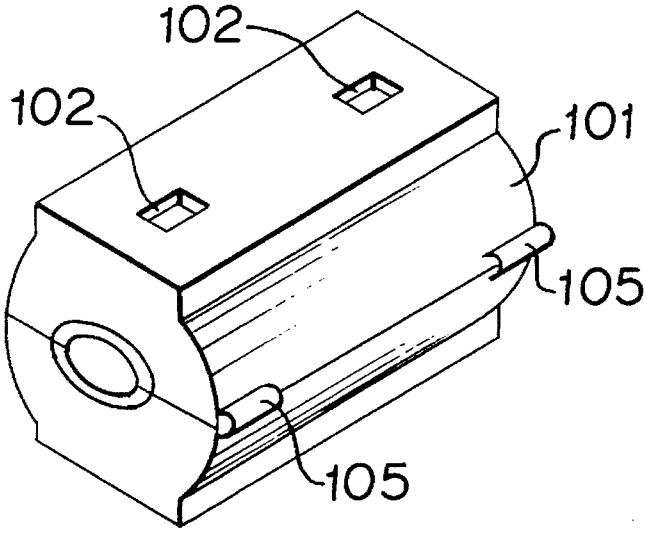
FIG. 7 is a perspective view showing the closed-state of the accommodation cases in FIG. 6.
Figure 8:
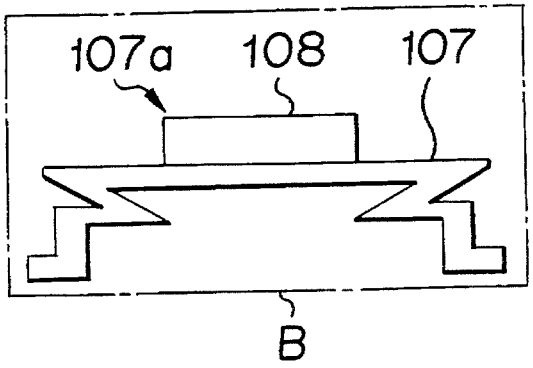
FIG. 8 is a side view of a pressing part in the third embodiment.
Figure 9:
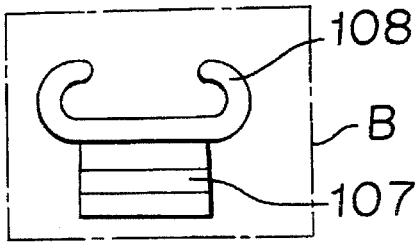
FIG. 9 is a side view in which the pressing part in FIG. 8 is rotated by 90°.
Figure 10:
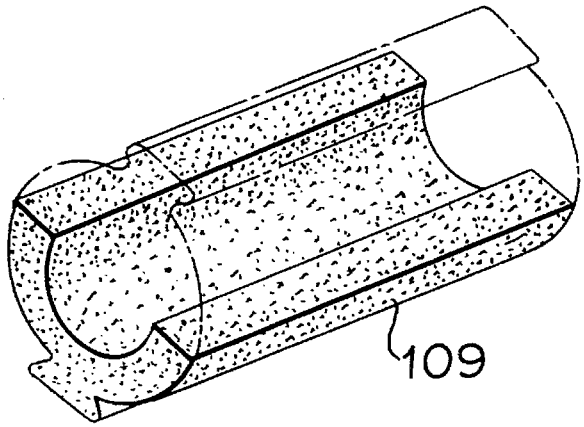
FIG. 10 is a perspective view of the magnetic core for a round cable in the third embodiment.

FIG. 6 is a perspective view of the accommodation cases in the third embodiment, FIG. 7, a perspective view showing the closed state of the accommodation cases in FIG. 6, FIG. 8, a side view of the pressing member in the third embodiment, FIG. 9, a side view in which the pressing member in FIG. 8 is rotated by 90° and FIG. 10, a perspective view of the magnetic core for a round cable in the third embodiment.

In FIGS. 6 and 7, a notation A designates an accommodation means, which is composed of a pair of accommodation cases 101, each accomodating the core 109 (mentioned later in FIG. 10). A notation B designates a press-contacting means, which is composed of the pressing member **107*a* (mentioned later in FIG. 8), which holds the core 109**, and fixes it in the accomodation cases engaging with the accommodation means A.

A numeral 102 designates holes which engage with and fix the pressing member **107*a* (FIG. 8) which are provided at the top and the bottom surfaces of the accommodation cases 101. Numerals 103 and 104 designate latches for latching the accommodation cases 101, and 105, hinges for opening and closing the accommodation cases 101**.

In FIGS. 8 and 9, the pressing member **107*a* is a resilient part which is engaged with the accommodation cases 101 (FIG. 6) and the cores for engaging and fixing the cores to the accommodation cases, which is composed of the resilient portion 107 and the claw 108 which holds the core 109 (FIG. 10**).

Next, explanation will be given to the operation of the third embodiment referring to FIGS. 6 through 10.

In FIG. 6, first, the pressing member **107*a* (FIG. 8) is engaged with the hole 102**.

The core 109 (FIG. 10) is fixed to the claw 108 (FIG. 8) of the pressing member **107*a***.

The same operation is performed in the opposing part of the signal discriminator.

The cases 101 are closed, and the latches 103 and 104 are connected.

Since the accommodation cases 101 have the hinges 105, the cases are closed. Since in the accommodation case 101, the cores 109 are held by the claws 108 of the pressing member **107*a*, the cores 109 do not drop off by the opening and the closing of the accommodation cases 101. Furthermore, since the pressing member 107*a* has resilience, the pressing member 107*a* presses the cores 109 from their back sides, and presses the contact surface thereof, thereby minimizing the gap between the cores. Furthermore, since engaging and disengaging of the latches 103 and 104 of the accommodation cases 101**, are easy, this signal discriminator can easily be attached to and detached from the cable.

In the third embodiment of the signal discriminator, an optimum pressing force can be obtained by changing the pressing member 107*a* corresponding with the electromagnetic characteristic of the core 109.

Next, explanation will be given to a fourth embodiment of the present invention referring to FIGS. 11 and 12.

Figure 11:
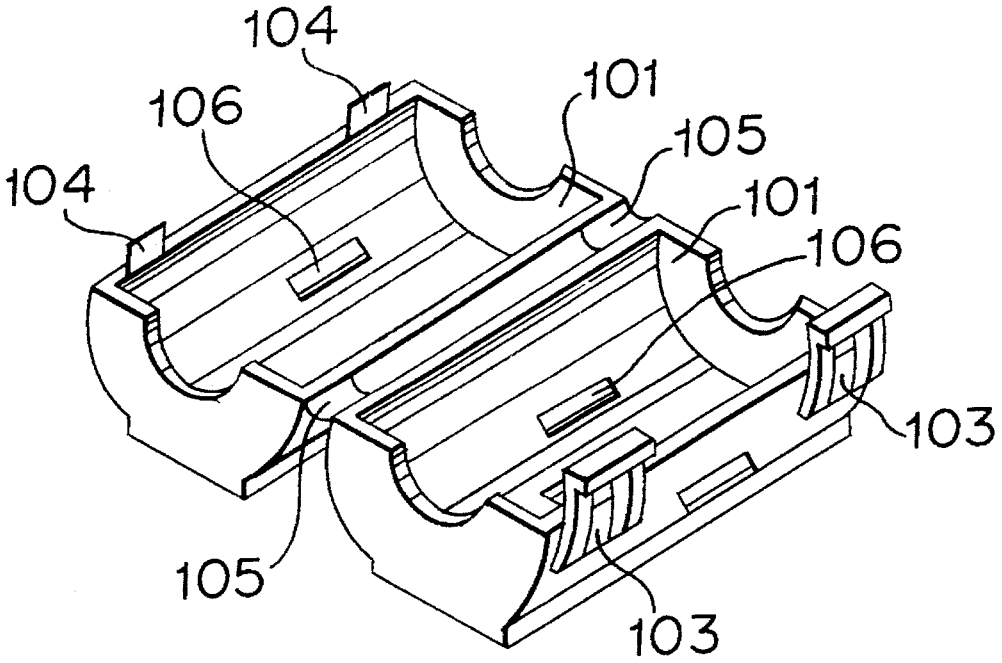
FIG. 11 is an exploded perspective view showing the open state of the accommodation cases in a fourth embodiment of this invention.
Figure 12:
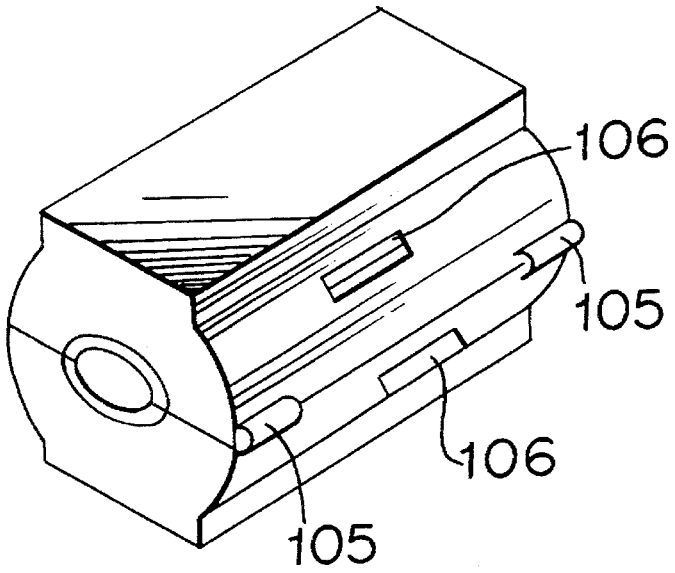
FIG. 12 is a perspective view showing the closed state of the accommodation cases in FIG. 11.

FIG. 11 is a perspective view showing the open-state of the accommodation cases in the fourth embodiment, and FIG. 12, a perspective view of the closed state of the accommodation cases in FIG. 11.

In the foregoing third embodiment, the holes 102 for engaging and fixing the pressing member 107*a* are provided at the bottom part of the accommodation case 101. In the fourth embodiment, these holes, designated as 106 are provided at the side portion of the accommodation case 101, as shown in FIGS. 11 and 12. The other composition and the operation is the same as in the third embodiment, and the duplicated explanation is omitted.

Furthermore, the effect of the fourth embodiment is the same with that in the third embodiment.

Next, explanation will be given to a fifth embodiment of the present invention referring to FIGS. 14 and 15.

Figure 14:
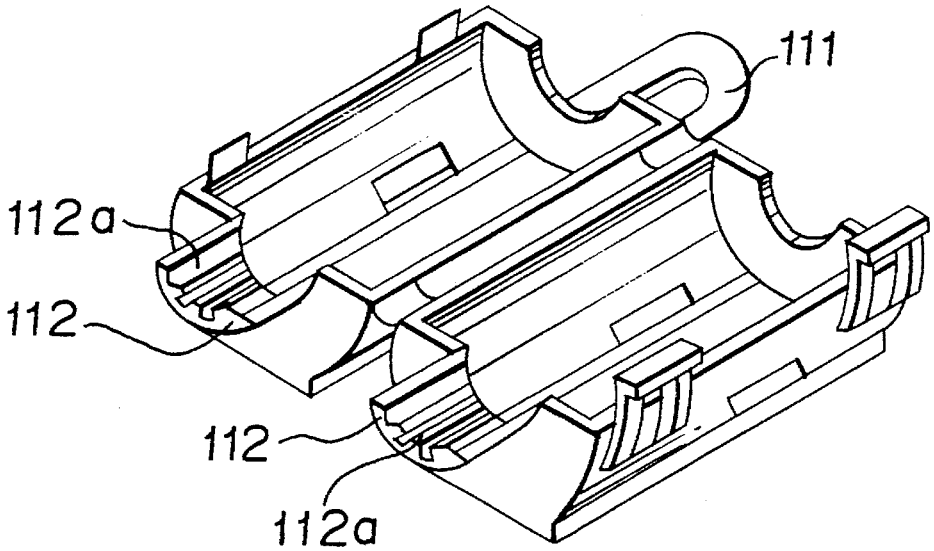
FIG. 14 is a perspective view showing the open state of the accommodation cases in a fifth embodiment of the present invention.
Figure 15:
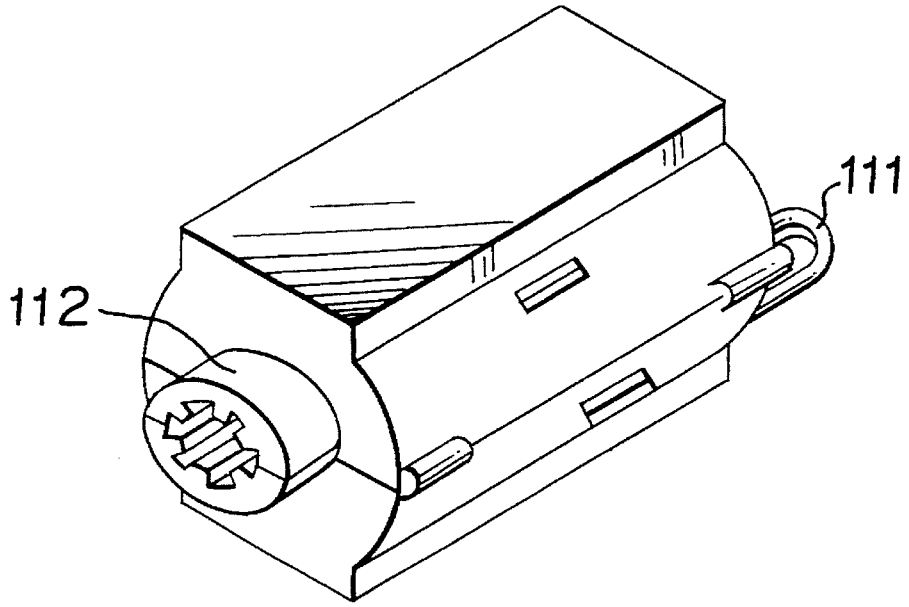
FIG. 15 is a perspective view showing the closed-state of the accommodation cases in FIG. 14.

FIG. 14 is a perspective view showing the open-state of the accommodation cases in the fifth embodiment of the present invention, and FIG. 15, a perspective view showing the closed state of the accommodation cases in FIG. 14.

In FIG. 14, the difference between the accommodation cases in FIG. 14 with those in the foregoing third embodiment, is in adding the flange 111 which can fix the accommodation cases to a substrate or the like, to the third embodiment (FIG. 6). Furthermore, the cable fixing member 112 is provided with protrusions and recesses at the inner portion of the cable engaging member 112*a*, facilitating the fixing and the positioning of the signal discriminator to the cable.

The operation of the fifth embodiment is the same as in the third embodiment, and the duplicate explanation is omitted.

Furthermore, in FIGS. 14 and 15, the flange 111 and the cable engaging member 112*a* are simultaneously provided to the signal discriminator. However the similar operation and effect can be obtained when each of them is provided in the signal discriminator.

Figure 13:
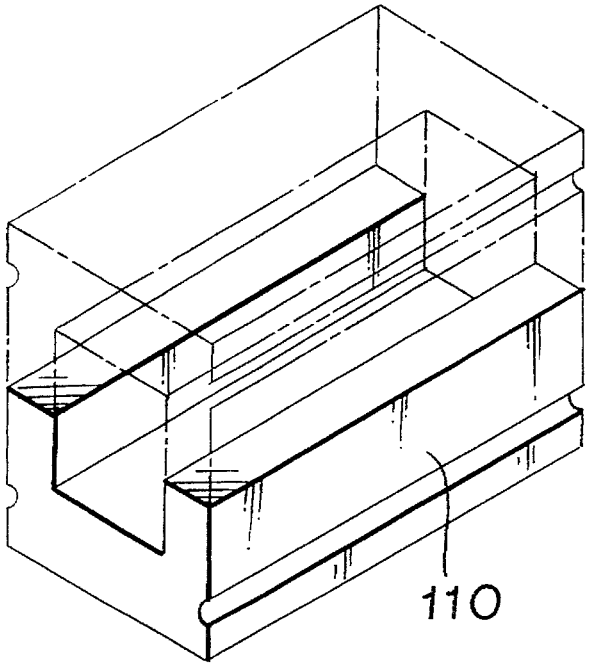
FIG. 13 is a conceptive diagram of the accommodation cases for a flat cable, which are used in the respective embodiments of the present invention.

Explanation has been given to the third embodiment through the the fifth embodiment, with respect to the signal discriminators for a round cable. However the same operation and the same effect are obtained for the signal discriminators having accommodation cases for accommodating the core for the flat cable 110, as shown in FIG. 13.

Figure 16:
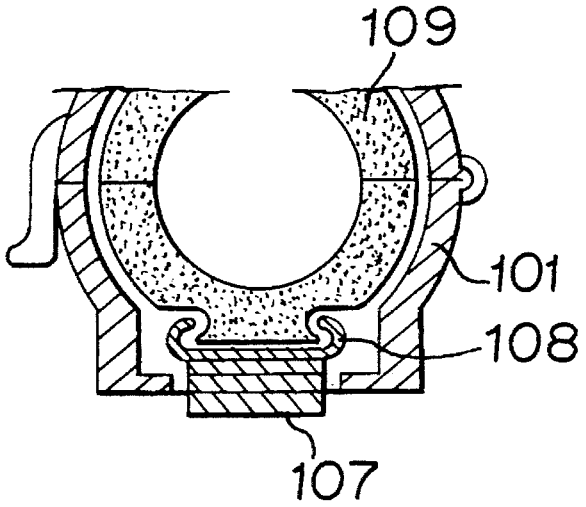
FIG. 16 is a sectional view showing the integration of the third embodiment.
Figure 17:
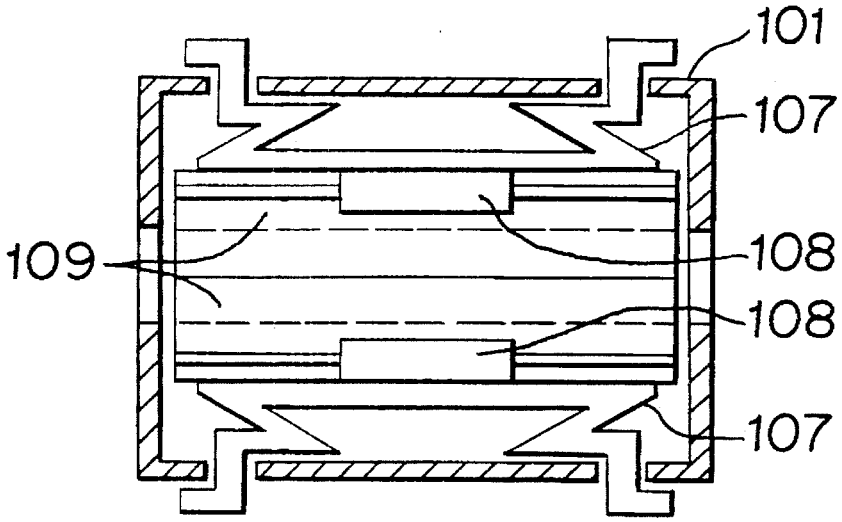
FIG. 17 is a partically broken sectional side view of FIG. 16.

Furthermore, the integrated sectional views of the third embodiment are shown in FIGS. 16 and 17.

Figure 18:
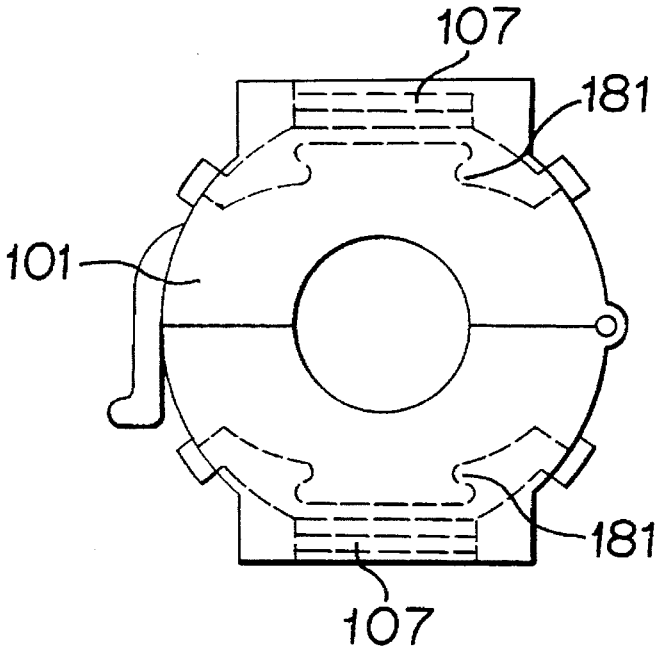
FIG. 18 is a side view of the integration of a sixth embodiment according to the present invention.

Next, explanation will be given to a sixth embodiment of the present invention using FIG. 18.

In the sixth embodiment, the pressing member 107*a* in the third embodiment, is changed with respect to its shape. Especially the claw 18 of the pressing member 107*a* in the third embodiment is changed with respect to its shape as shown in FIG. 18, in which the claw 181 is fixably engaged with the accommodation case 101.

The operation and the effect of the sixth embodiment are the same with those in the third embodiment.

Figure 19:
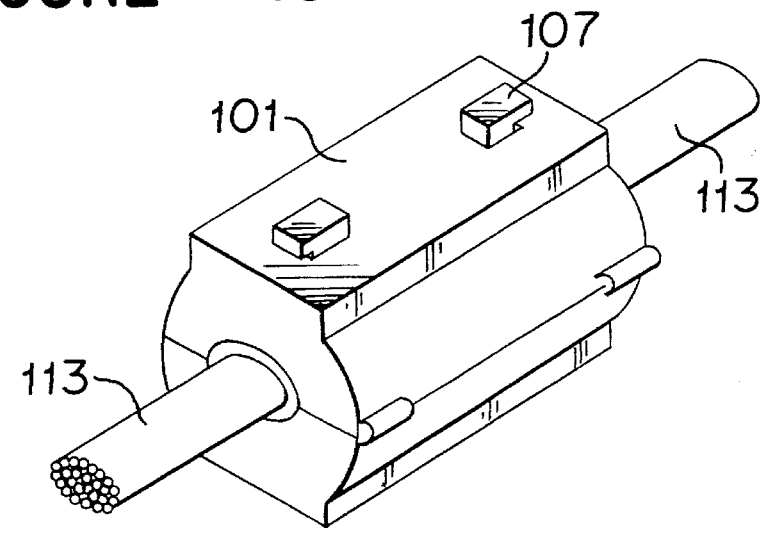
FIG. 19 is a perspective view showing an example of a signal discriminator of the present invention in use.
Figure 20:
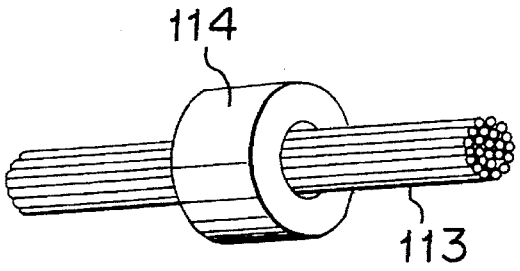
FIGURE 20 (PRIOR ART)
FIG. 20 is a perspective view showing a first conventional example of the signal discriminator for flat cable in use.
Figure 21:
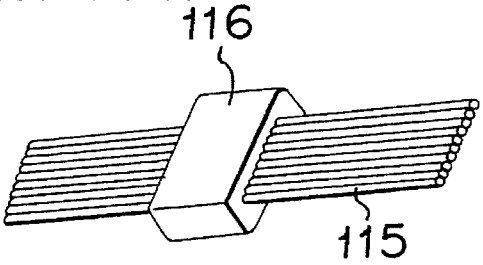
FIGURE 21 (PRIOR ART)
FIG. 21 is a perspective view showing the first conventional example of the signal discriminator for a flat cable in use.
Figure 22:
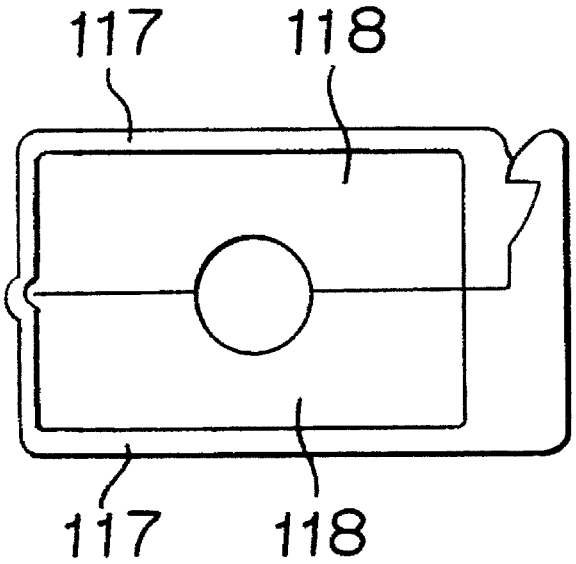
FIGURE 22 (PRIOR ART)
FIG. 22 is a side view of the accommodation cases of a second conventional example.
Figure 23:
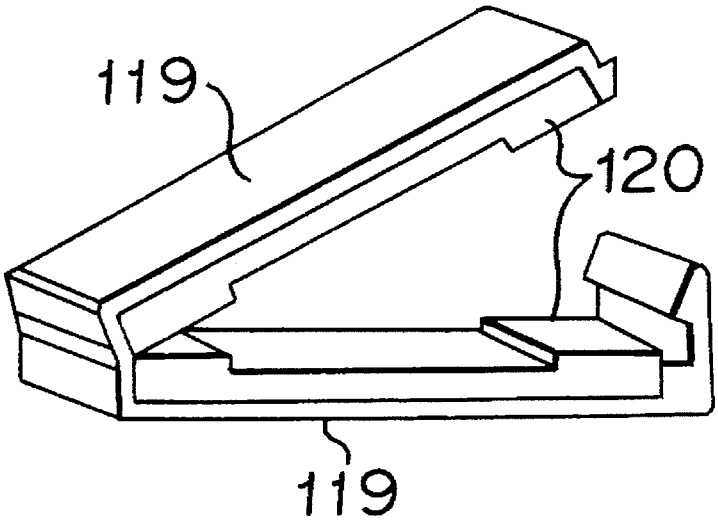
FIGURE 23 (PRIOR ART)
FIG. 23 is a perspective view showing the open-state of the accommodation cases as in FIG. 22.

The signal discriminator in the third embodiment in use, is shown in FIG. 19.

In this invention, as stated above, according to the present invention, a signal discriminator is provided in which an independent pressing member can press the magnetic cores which are divided in the axial direction, and which has a pressing mechanism corresponding with the electromagnetic characteristic of the magnetic core. Furthermore, this invention can provide a signal discriminator of which production cost is inexpensive, and of which handling is simplified.

Figure 24:
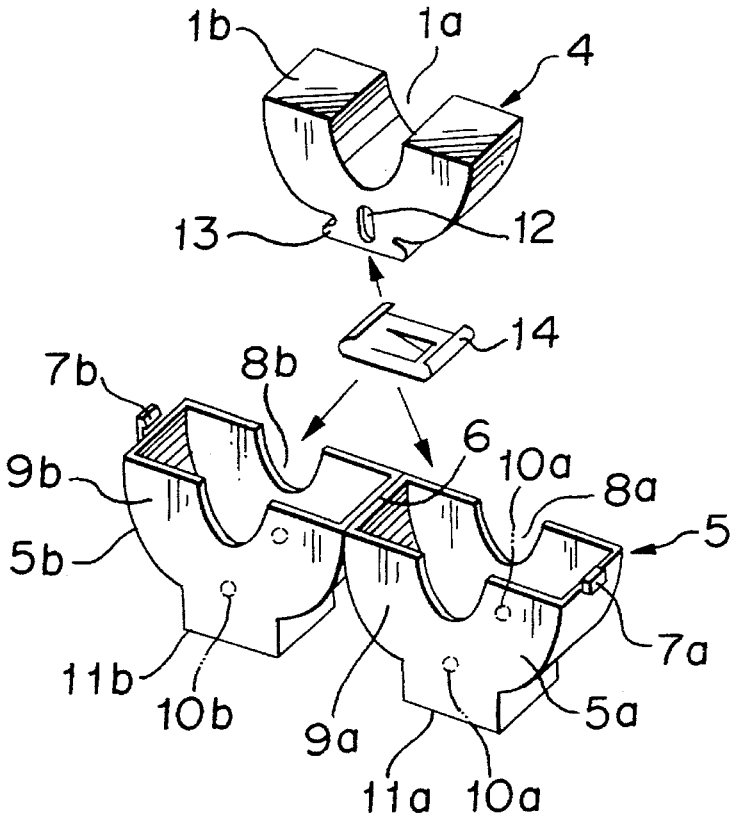
FIG. 24 is an exploded perspective view of a seventh embodiment of the signal discriminator.
Figure 35:
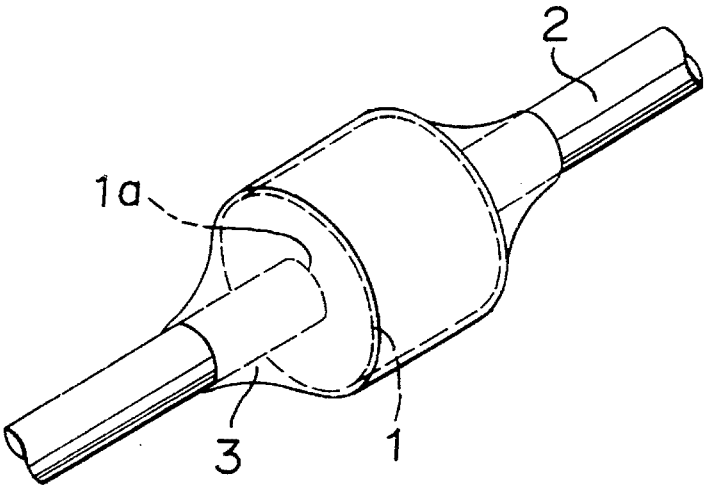
FIGURE 35 (PRIOR ART)
FIG. 35 is a perspective view of a third conventional example.
Figure 36:
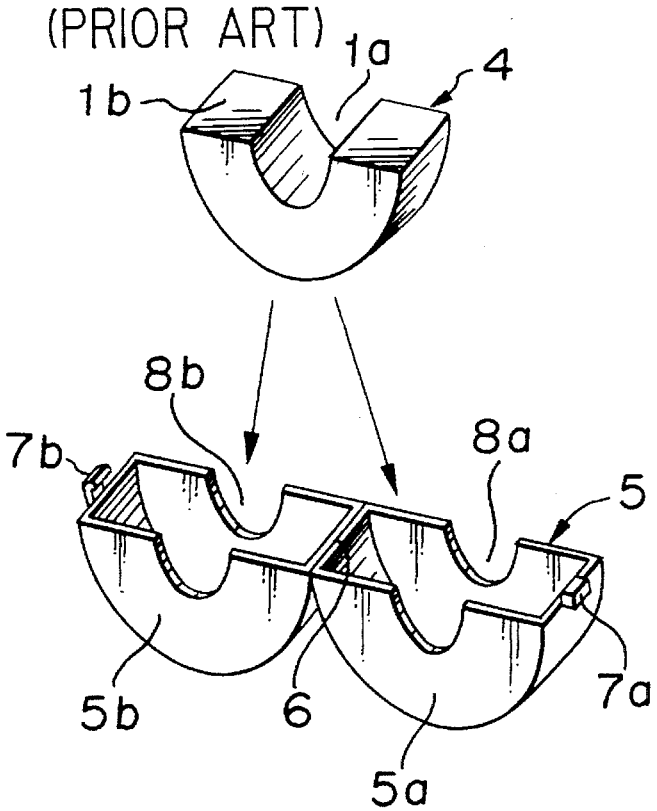
FIGURE 36 (PRIOR ART)
FIG. 36 is an exploded perspective view of a fourth conventional example.

FIG. 24 is an exploded perspective view of a seventh embodiment of the signal discriminator. In FIG. 24, the same notation in FIGS. 35 and 36 designates the same or the corresponding parts. The case 5 is formed similar to that in FIG. 36. However, in FIG. 24, the cases 5*a* and 5*b* have respectively engaging protrusions 10*a* and 10*b* at the inner portions of the side faces 9*a* and 9*b*. Furthermore the cases 5*a* and 5*b* have the spring accommodation portions 11*a* and 11*b* at their peripheral portions. The whole body of the cases 5*a* and 5*b* are composed of resilient material as in the side faces 9*a* and 9*b*.

The cores 4 have the engaging recesses 12 which engage with the engaging protrusions 10*a* and 10*b*, and the spring engaging portions 13 at their peripheral portions, which are accommodated in the spring accommodating portions 11*a* and 11*b*. The engaging protrusions 10*a* and 10*b* and the engaging recesses 12 compose an engaging means. A reference numeral 14 designates a press-contacting spring as a press-contacting member, two of which are accommodated in the spring accommodation portions 11*a* and 11*b*, being attached to the spring engaging portions 13, pressing the divided surfaces 1*b* of the cores 4.

In the signal discriminator constructed as above, the cores 4 are respectively accommodated in the cases 5*a* and 5*b* while the press-contacting springs 14 are attached to the spring engaging portions 13 of the cores 4. In FIG. 24, only one of the cores 4 and one of the press-contacting springs 14 are shown. However for each of the cases 5*a* and 5*b*, each single core 4 and each single press-contacting spring are accommodated.

The engaging protrusions 10*a* and 10*b* are engaged to the engaging recesses 12 by using the resilience of the side faces 9*a* and 9*b* of the cases 5*a* and 5*b*, and the spring engaging portions 13 and the press-contacting springs 14 are accommodated in the spring accommodating portions 11*a* and 11*b*. When the cases 5*a* and 5*b* are closed so that the cable penetrates the through holes la, 8*a* and 8*b*, the divided surfaces 1*b* are integrally contacted without dropping off the two cores 4, thereby forming a closed magnetic path around the cable 2.

When the current flows in the cable 2, the noise element is eliminated corresponding with the impedance characteristics of the core, and the necessary signal is discriminated. The control of the press-contacting force of the core 4 corresponding with the electromagnetic characteristic of the core, is performed by exchanging the press-contacting spring.

Since the core 4 has no protrusion, although it has the engaging recess 12, the handling thereof in pressing for removal of a die and sintering thereof for posture in a furnace is facilitated. Furthermore, in the case 5, the forming thereof is easy since there are only the engaging protrusions 10*a* and 10*b*, and the handling thereof is easy.

Figure 25:
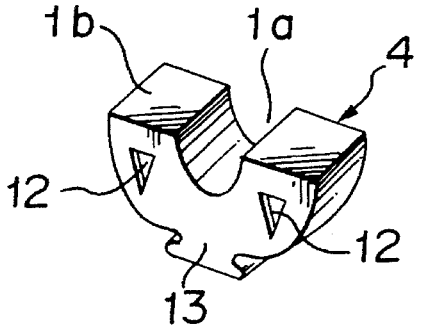
FIG. 25 is a perspective view of the divided magnetic core in an eighth embodiment.
Figure 26:
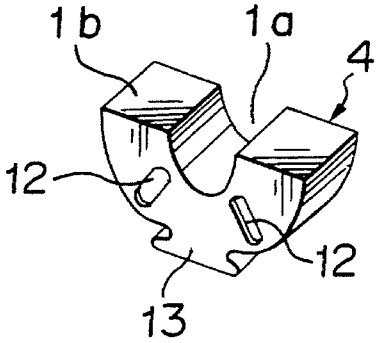
FIG. 26 is a perspective view of the divided magnetic core in a ninth embodiment.

FIGS. 25 and 26 are perspective views showing the cores in an eighth and in a ninth embodiments. In the foregoing seventh embodiment, the shape of the engaging protrusion 12 is guasi-oval. However in the eighth embodiment shown in FIG. 25, the shape of the engaging recess 12 is a triangle. In the ninth embodiment shown in FIG. 26, the protrusion recesses 12 having the same shape with that in the seventh embodiment, are provided in two and with different angles symmetrically arranged with respect to the verical center line. In these embodiments, when the cores 4 are pressed by the press-contacting springs 14, the cores 4 move so that the relative motion between the cases 5 and the core 4 is minimized, and the contact accuracy of the cores 4 is always maintained constant, thereby promoting the electromagnetic characteristic thereof.

Figure 27A:
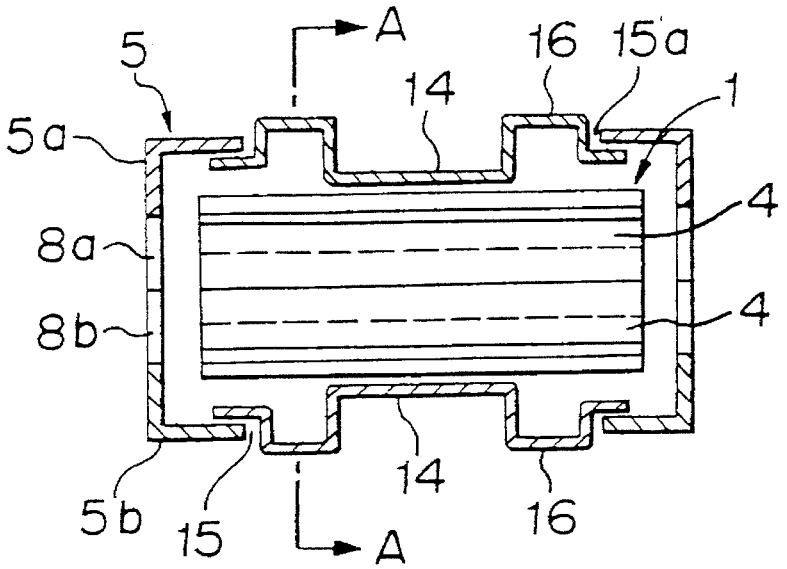
FIGS. 27A and 27B are respectively a partially broken sectional vertical view and a sectional view taken along the line A—A in FIG. 27A, of a tenth embodiment.
Figure 27B:
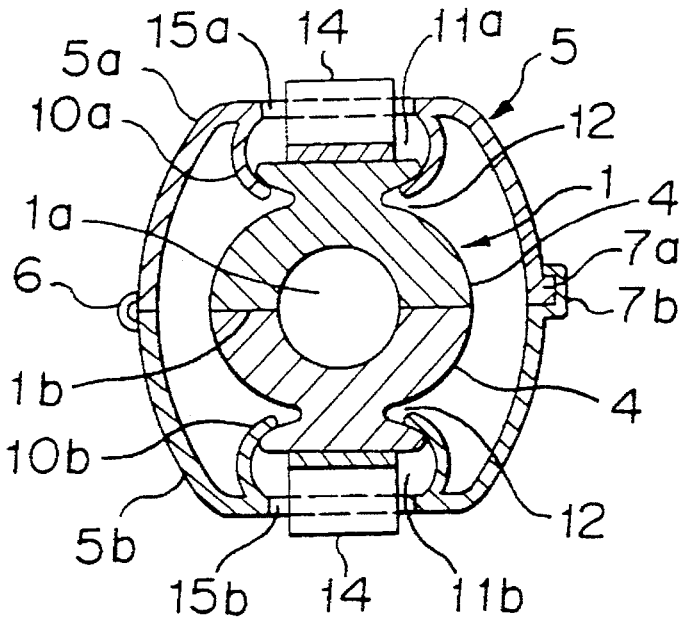

FIGS. 27A and 27B show a tenth embodiment, wherein FIG. 27A is a sectional vertical view, and FIG. 27B, a sectional view taken along the line A—A in FIG. 27A. In FIGS. 27A and 27B, the same notation in FIGS. 24 through 26 designates the same or the corresponding parts. In this embodiment, the bottom surfaces of the cases 5*a* and 5*b* which compose the case 5, are cut and bent vertically to the drawing, thereby forming the engaging protrusions 10*a* and 10*b*. In portions surrounded by the engaging protrusion 10*a* and 10*b*, the spring accommodating portions 11*a* and 11*b* are formed which have the openings 15*a* and 15*b* as positioning portions. In the cores 4, the engaging recesses 12 are formed for engaging with the engaging protrusions 10*a* and 10*b*. The press-contacting springs 14 have a couple of protrusions 16 which engage with the openings 15*a* and 15*b*. When the contact surfaces 1*b* of the cores 4 are press-contacted, the engaging protrusions 10*a* and 10*b* do not contact the engaging recesses 12. The other construction is the same as in the seventh embodiment shown in FIG. 24.

In the above signal discriminator, the press contacting springs 14 are inserted in the spring accommodating portions 11*a* and 11*b* of the cases 5*a* and 5*b*, and the positioning thereof is performed by engaging the protrusions 16 with the openings 15*a* and 15*b*. The cores 4 are accommodated in the cases 5*a* and 5*b* by engaging the engaging protrusions 10*a* and 10*b* with the engaging recesses 12 of the cores 4. As in the foregoing examples, the cases 5*a* and 5*b* are closed in such engaging state, thereby forming the signal discriminator.

The tenth embodiment of the signal discriminator has the similar operation and the similar effect as in the foregoing embodiments. Since the press-contacting springs 14 are positioned by the openings 15 and 15*b*, the press-contacting force can be maintained constant.

Figure 28A:
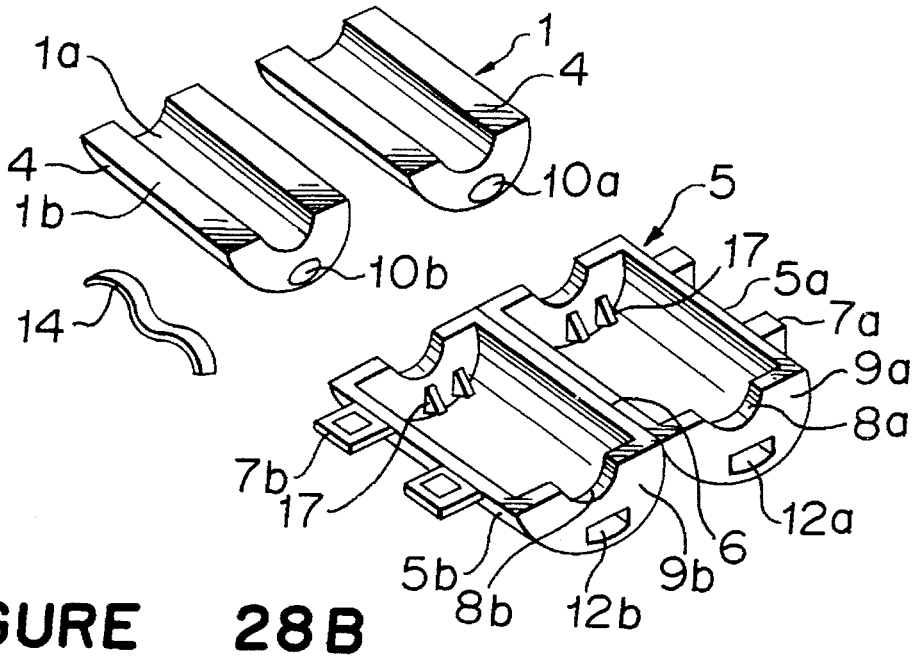
FIGS. 28A, 28B and 28C are respectively an exploded perspective view, a sectional vertical view and a perspective view of an eleventh embodiment.
Figure 28B:
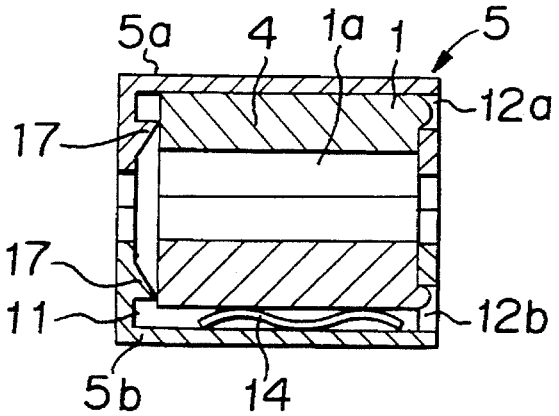
Figure 28C:
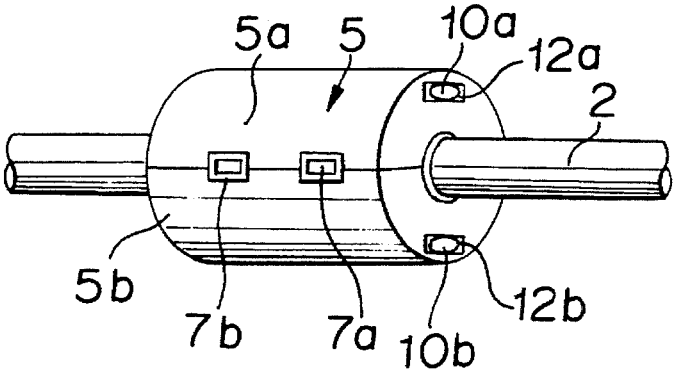

FIGS. 28A, 28B and 28C show the eleventh embodiment, wherein FIG. 28A is an exploded perspective view, FIG. 28B, a vertical sectional view, and FIG. 28C, a perspective view. In this embodiment, the engaging protrusions 10*a* and 10*b* are formed at one end of the cores 4. The engaging recesses (holes) 12*a* and 12*b* are correspondingly formed at one end of the side faces 9*a* and 9*b* of the cases 5*a* and 5*b*. The engaging protrusions and the engaging recesses compose an engaging means. At the inner portions of side faces opposing the engaging recesses 12*a* and 12*b*, the wedge-like (louver-like) protrusions 17 are formed. The single press-contacting spring 14 is inserted between the case 5*b* and the core 4. The other construction is the same as in the foregoing embodiments.

In the above signal discriminator, the press-contacting spring 14 is placed at one of the cores 4, and the cores 4 are accommodated-in the cases 5*a* and 5*b*, so that the engaging protrusions 10*a* and 10*b* engage with the engaging recesses 12*a* and 12*b*, and the opposing end of the core 4 is fixed by contacting the opposing end to the wedge-like protrusions 17.

In this embodiment, the similar operation and the similar effect as in the preceding embodiments, are obtained. Since the engaging protrusions 10*a* and 10*b* are formed on the side of the core 4, the sectional area of the cores 4 which form a closed magnetic path, is not particularly reduced by an engaging recess. Accordingly this type of the core 1 has an excellent electromagnetic characteristic.

Figure 29A:
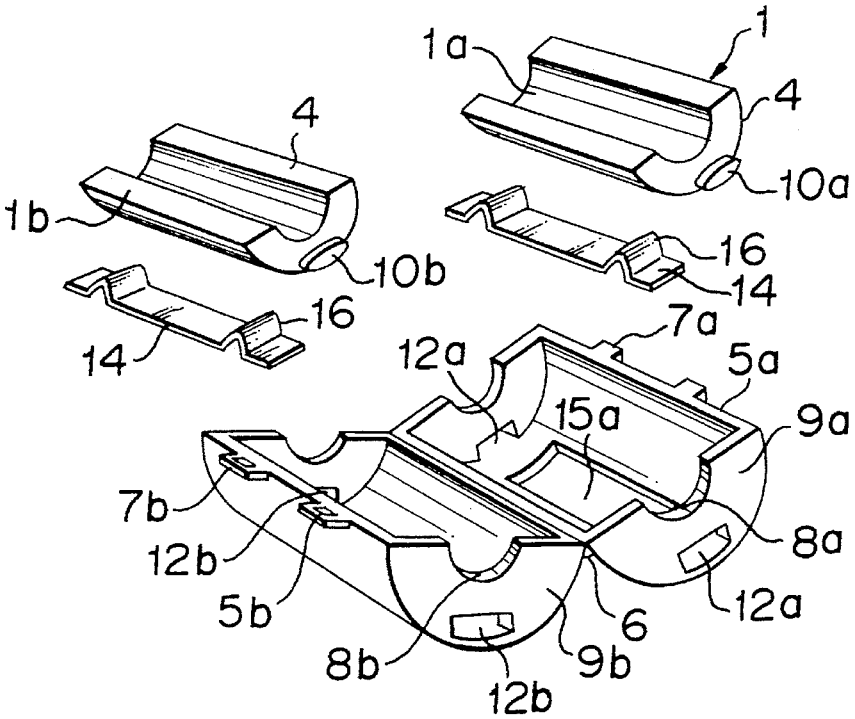
FIGS. 29A, 29B and 29C are respectively an exploded perspective view, and a sectional vertical view and a perspective view of a twelfth embodiment.
Figure 29B:
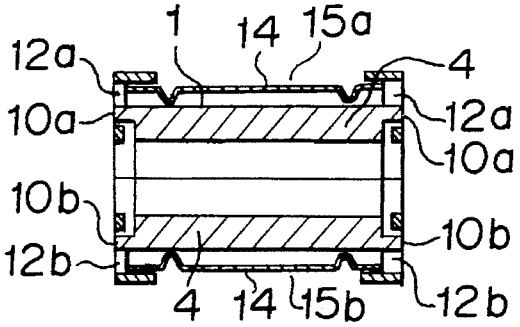
Figure 29C:
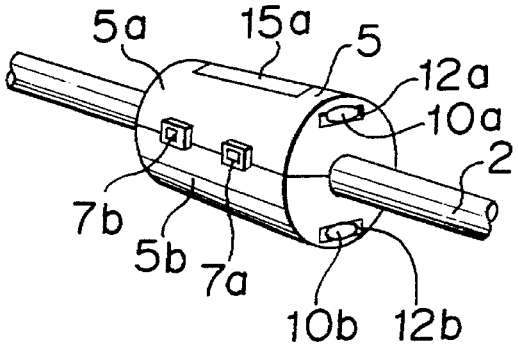

FIGS. 29A, 29B and 29C show a twelfth embodiment, wherein FIG. 29A is an exploded perspective view, FIG. 29B, a sectional vertical view, and 29C, a perspective view. In this embodiment, the engaging protrusions 10*a* and 10*b* are formed at both ends of the core 4. The engaging recesses (holes) 12*a* and 12*b* are correspondingly formed at both side faces 9*a* and 9*b* of the cases 5*a* and 5*b*. The engaging protrusions and the engaging recesses compose an engaging means.

While the engaging protrusions 10*a* and 10*b* at one side are being inserted in the engaging recesses 12*a* and 12*b*, respectively, the engaging protrusions 10*a* and 10*b* at the other side are inserted into the engaging recesses 12*a* and 12*b*, respectively, by utilizing the resilience of the cases 5*a* and 5*b*.

In this embodiment the similar operation and effect are obtained as in the foregoing embodiments. Since the engaging protrusions 10*a* and 10*b* are formed at both ends of the core 4, the prevention of dropping off the core 4 is highly effective. Furthermore since the press-contacting spring 14 is accurately positioned, the press-contacting force can be maintained constant.

Figure 30A:
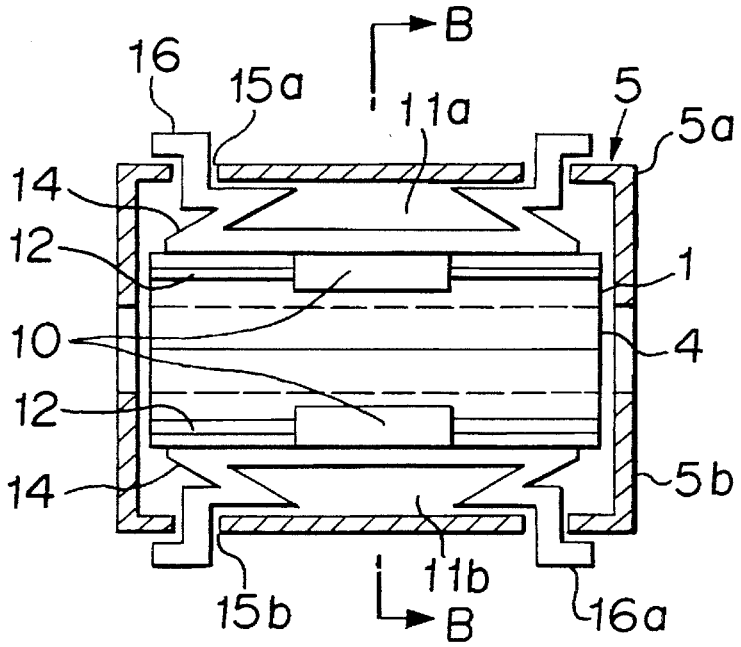
FIGS. 30A and 30B are respectively a partially broken sectional vertical view and a sectional view taken along the line B—B in FIG. 30A of a thirteenth embodiment.
Figure 30B:
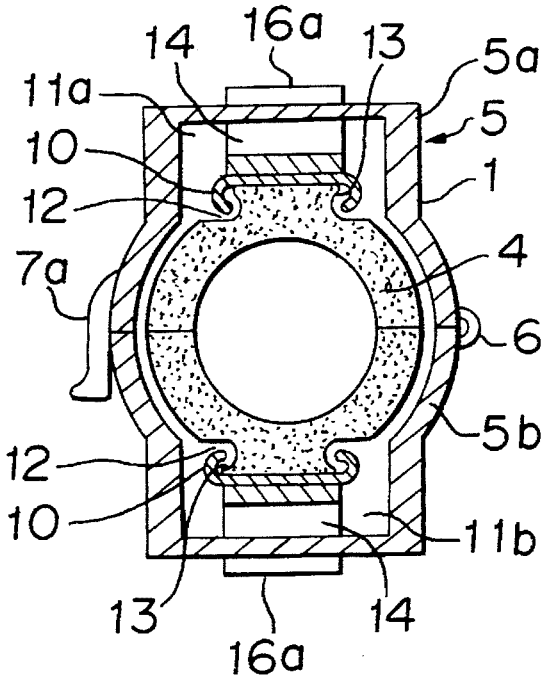

FIGS. 30A and 30B show a thirteenth embodiment, wherein FIG. 30A is a partially broken sectional vertical view, and FIG. 30B is a sectional view taken along the line B—B of FIG. 30A. In this embodiment, the core 4 is composed similar to that in FIG. 24. However in this embodiment, the engaging protrusion 10 provided at the press-contacting spring 14, is engaged with the engaging recess 12 formed at the spring engaging portion 13. In the spring accommodating portions 11*a* and 11*b* of the cases 5*a* and 5*b*, the openings 15*a* and 15*b* are provided as positioning portions, with which the protrusions 16*a* of the press contacting spring 14 engages.

In the above signal discriminator, the protrusions 16*a* of the press-contacting springs 14 are engaged with the openings 15*a* and 15*b* of the cases 5*a* and 5*b*. The press-contacting springs 14 are accommodated in the spring accommodating portions 11*a* and 11*b*. The engaging recesses 12 of the cores 4 are engaged with the engaging protrusions 10 of the press-contacting springs 14, by which the cores 4 are retained in the cases 5*a* and 5*b*.

In this embodiment, the similar operation and effect are obtained as in the other embodiment. Since the cores 4 are retained by the press contacting springs 14, the cases 5*a* and 5*b* can dispense with the engaging means, which facilitates the production and the mounting thereof.

Figure 31:
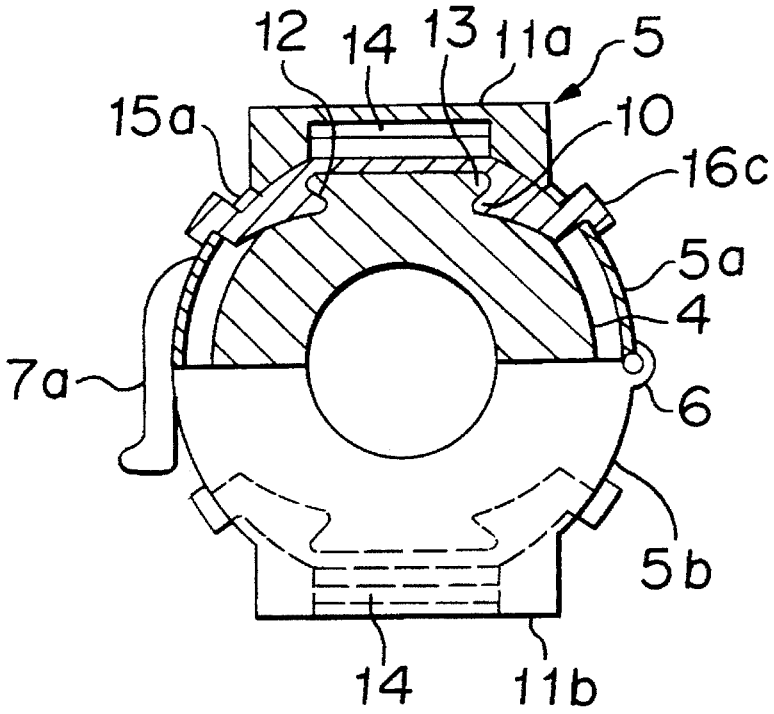
FIG. 31 is a-partially broken front view of a fourteenth embodiment.
Figure 32:
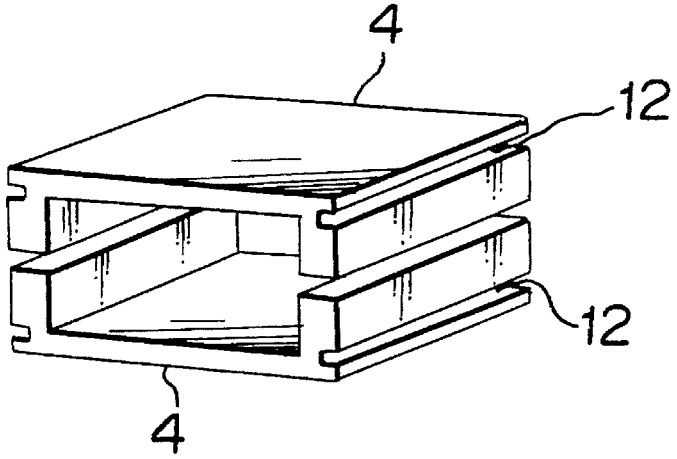
FIG. 32 is a perspective view If the divided magnetic core in a fifteenth embodiment.

FIG. 31 is a partially broken front view of a fourteenth embodiment. This embodiment is constructed similar to that in FIGS. 30A and 30B. However the openings 15*a* and 15*b* are provided at adjacent to and at both sides of the spring accommodating portions 11*a* and 11*b*. The protrusions 16*c* of the press-contacting springs 14 are formed so that they can engage with the opening portions 15*a* and 15*b*. This embodiment has similar operation and effect as in the embodiment in FIGS. 30A and 30B FIG. 32 is a perspective view showing the core in a fifteenth embodiment. This embodiment is suitable for attaching to a flat cable as the cable 2.

Figure 33:
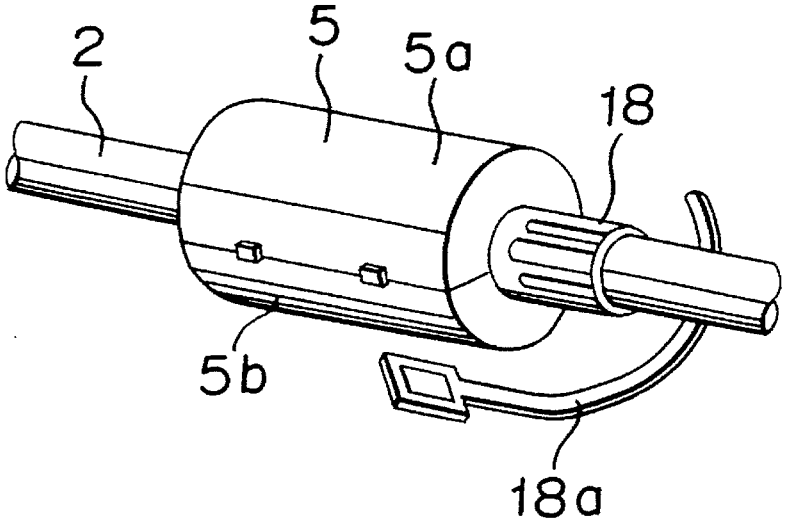
FIG. 33 is a perspective view of a sixteenth embodiment.

FIG. 33 is a perspective view showing a sixteenth embodiment. In FIG. 33, the cable fixing nozzle 18 is provided at ends of the cases 5*a* and 5*b*, which is bound by the binding band 18*a*.

Figure 34:
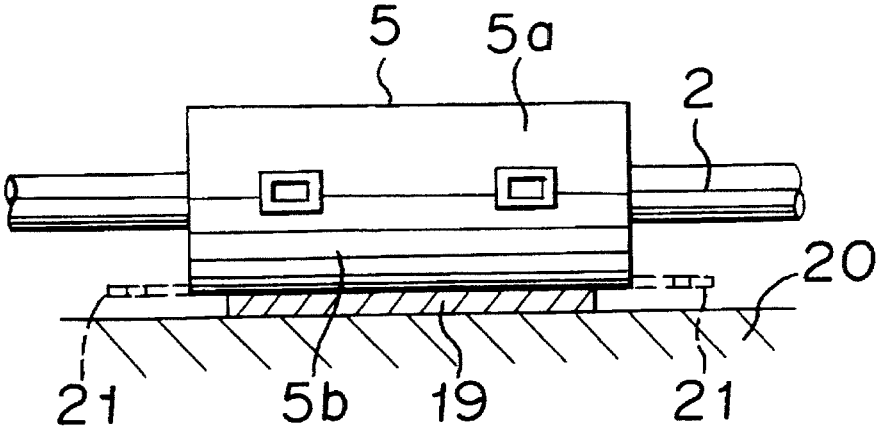
FIG. 34 is a side view of a seventeenth embodiment.

FIG. 34 is a side view showing a seventeenth embodiment. In FIG. 34, the case 5*b* is stuck to an outside attached member 20 by the adhesive 19. It is possible to fix the case 5 to the outside attached member 20 by providing the flange 21 at the case 5*b*, and fixing the flange 21 to the outside attached member 20 by screws or the like.

Furthermore, in the above explanation, the cable 2 may be a wire, or a plurality of wires or a cable. In the case of cable, any cable such as a round cable or a flat cable is applicable to this invention, and corresponding with these the shapes of the core 4 and the case 5*a* and 5*b* can be selected.

According to the signal discriminator of this invention, the press-contacting parts and the engaging means are provided separately with the cases. Therefore in this invention the cores do not drop off and are easily attached around the cable, thereby forming a closed magnetic path. The press-contacting force can be changed corresponding with the electromagnetic characteristic of the core.

According to the signal discriminator of the present invention, since an engaging recess is formed at the core, as an engaging means, the production thereof is easy and the handling thereof is favorable.

According to the signal discriminator of the present invention, since an engaging protrusion is formed at the core, as an engaging means, the sectional area of the cores which forms a closed magnetic path, does not decrease, thereby obtaining an excellent electromagnetic characteristic.

According to the signal discriminator of the present invention, the shapes of the engaging protrusion and the engaging recess are determined, so that when the core is press-contacted by the press-contacting means, in the engaging state, the cores are contacted at a predetermined position, thereby always maintaining constant the contact accuracy, and promoting the electromagnetic characteristic thereof.

According to the signal discriminator of the present invention, since the engaging recesses and the engaging protrusions are provided at both sides of the cores, dropping-off of the cores is highly prevented.

According to the signal discriminator of the present invention, since the positioning portion of the press contacting means is provided at the case, the press-contacting force can be maintained constant.

According to the signal discriminator of the present invention, since the press-contacting means is fixed to the case, so that the press-contacting means and the cores are fixed, the case can dispense with the engaging means, thereby facilitating the production and the mounting thereof.

According to the signal discriminator of the present invention, since the fixing means thereof to the cable, is provided, the signal discriminator can be fixed to a predetermined position of the cable.

According to the signal discriminator of the present invention, since the attaching means to an outside attached portion, is provided, the signal discriminator can be attached to a predetermined position of the outside attached portion.

We claim:

1. A signal discriminator comprising:

a plurality of divided magnetic cores, each having an engaging protrusion;

a resin case formed of a plurality of sections, each section having a recess for engagingly accommodating a respective engaging protrusion from a corresponding one of the plurality of divided magnet cores, wherein the engaging protrusions and the recesses are respectively formed at both ends of each of the plurality of divided magnetic cores and at both ends of each of the plurality of sections of the resin case; and a plurality of press-contacting means formed of a resilient material, wherein a respective one of the plurality of press-contacting means is arranged between each of the plurality of divided magnetic cores and the corresponding one of the plurality of sections of the resin case, and wherein each of the plurality of press-contacting means comprise a unitary resilient member having at least two protrusions;

a cut-out portion formed in each section of the resin case at a position where the respective of the plurality of press-contacting means is arranged, a portion of the respective of the plurality of press-contacting means extending beyond the cut out portion such that each end of the plurality of press-contacting means contacts a respective end of the plurality of sections of the resin case.

2. The signal discriminator according to claim 1, further comprising:

cable fixing means for fixing a cable which penetrates through the resin case at a portion of the resin case through which the cable penetrates.

3. The signal discriminator according to claim 1, further comprising:

cable fixing means for fixing a cable which penetrates through the resin case at a portion of the resin case through which the cable penetrates.

* * * * *